United States Patent [19]

Falxa

[11] Patent Number: 4,741,396

[45] Date of Patent: May 3, 1988

[54] HYDROSTATIC SYRINGE FOR DEPOSITING PROCESSING PRODUCTS IN WELLS

[75] Inventor: Henri Falxa, Bidart, France

[73] Assignee: Societe Nationale Elf Aquitaine (Production), France

[21] Appl. No.: 939,560

[22] Filed: Dec. 9, 1986

[30] Foreign Application Priority Data

Dec. 9, 1985 [FR] France ..... 85 18168

[51] Int. Cl.[4] ..... E21B 27/00

[52] U.S. Cl. ..... 166/169

[58] Field of Search ..... 166/165, 169, 162, 163, 166/166–168

[56] References Cited

U.S. PATENT DOCUMENTS

| | | | |
|---|---|---|---|
| 2,141,179 | 12/1938 | Ennis | 166/165 |
| 2,147,983 | 2/1939 | Lindsly | 166/165 |
| 2,572,493 | 10/1951 | Klaasen et al. | 166/165 |
| 2,577,210 | 12/1951 | Ruska | 166/165 |
| 2,896,723 | 7/1959 | Barnes | 166/166 |
| 3,692,106 | 9/1972 | Basham et al. | 166/169 |

FOREIGN PATENT DOCUMENTS 2087013 12/1971 France .

*Primary Examiner*—James A. Leppink
*Assistant Examiner*—Hoang C. Dang
*Attorney, Agent, or Firm*—Ostrolenk, Faber, Gerb & Soffen

[57] ABSTRACT

Equipment for depositing processing products in wells after being lowered inside production tubes for depositing cement to seal perforations in the production tube and also for depositing detergents or acid.

A syringe comprises a clock mechanism which, after a given period of time and through the medium of a striker for piercing a cap which seals a pressurized oil reservoir, actuates a hydraulic bolt comprising a barrel, a piston, a fixed liner encased in a movable liner and means for maintaining the movable liner in a raised position.

A central rod rigid with the movable liner traverses a syringe body, of which the filling space is provided with discharge orifices co-operating with a valve carried by the end of the central rod.

4 Claims, 2 Drawing Sheets

HYDROSTATIC SYRINGE FOR DEPOSITING PROCESSING PRODUCTS IN WELLS

The present invention relates to a hydrostatic syringe for depositing liquid or solid processing products in wells and more particularly comprising a container lowered into the well by means of a cable and provided with a device for controlling the discharge of products to be deposited.

While a field is being worked, such syringes are used for depositing opposite punctures in the casing tube various processing substances such as cement for sealing rows of perforations, when water comes in, acid for opening or cleaning out fissures, detergents for changing the surface tension of effluents or to allow the raising of water from the field.

The equipment used for this purpose has to be introduced into a series of production tubes having different interior diameters. Precautions have to be taken so that the lowering of a greater or smaller volume of products can be carried out without any risk of jamming. According to the prior art, the majority of known methods employ a process for triggering the opening of the container by electrical means. Such equipment is dependent on an electric cable which may have insulation faults due to friction, be damaged as it passes over the well head, or which may be crushed in a well which has changed direction or it may have a faulty splice. Therefore, these products entail the risk of damaging electric cables, particularly in the case of deep wells or those in which there is considerable heat and they are therefore not really viable.

Other methods which entail controlling the release of cement into the well by mechanical means actuated from the surface are likewise not readily viable and not very accurate, particularly in the case of deep or deflected wells.

The syringe according to the invention makes it possible for cement plugs to be deposited in complete safety at desired depths, with considerable accuracy at specified levels in wells in which the temperature is elevated, and it requires only conventional equipment while the speed of use is remarkable.

The syringe according to the invention is characterised in that it comprises a clock mechanism which ensures rotation of a rod of which, after a desired period, the end releases a block which actuates a striker, a hydraulic bolt comprising a cylinder of oil which is pressurised by the well during the course of descent, in which cylinder, disposed in a bolt body, a piston slides, the bolt body terminating in a cylindrical hollow part which forms a fixed liner, a slidingly movable liner enclosing the said hollow cylindrical part and means for locking the said liner in a raised position, at least one syringe body comprising a space to be filled with products to be deposited and provided in its lower part with discharge orifices and an end and guide union screwed on the end of the syringe body, and a central rod carrying a valve co-operating with the discharge orifices in order to retain the volume of products or allow the products to be deposited at the desired moment.

According to an advantageous embodiment, the end of the hollow cylindrical part of the bolt body is rigid with an end nut which has an axial bore in which slides the end of the piston rod.

Preferably, a restoring spring bearing on the said nut and on a shoulder on the said rod makes it possible to bias the piston rod so that it tends to slide.

The means for locking the movable liner in position comprise notches provided on the fixed liner and the movable liner and which, in conjunction with an enlarged cross-section of the piston, form a housing for balls maintaining the movable liner in a raised position.

It is possible to screw onto the syringe body the body of an opening mechanism provided with orifices for discharge of products to be deposited, a spring bearing on the shoulder of the said body and exerting its thrust on the central rod carrying the valve and seeking to restore the said control rod. The bottom end of the central rod slides freely in the end and guiding union to which it is fixed by means of a nut.

Other special features of the invention will become evident from reading the ensuing description of an embodiment which is given by way of example and which is illustrated in the accompanying drawings, in which.

Figure 1:
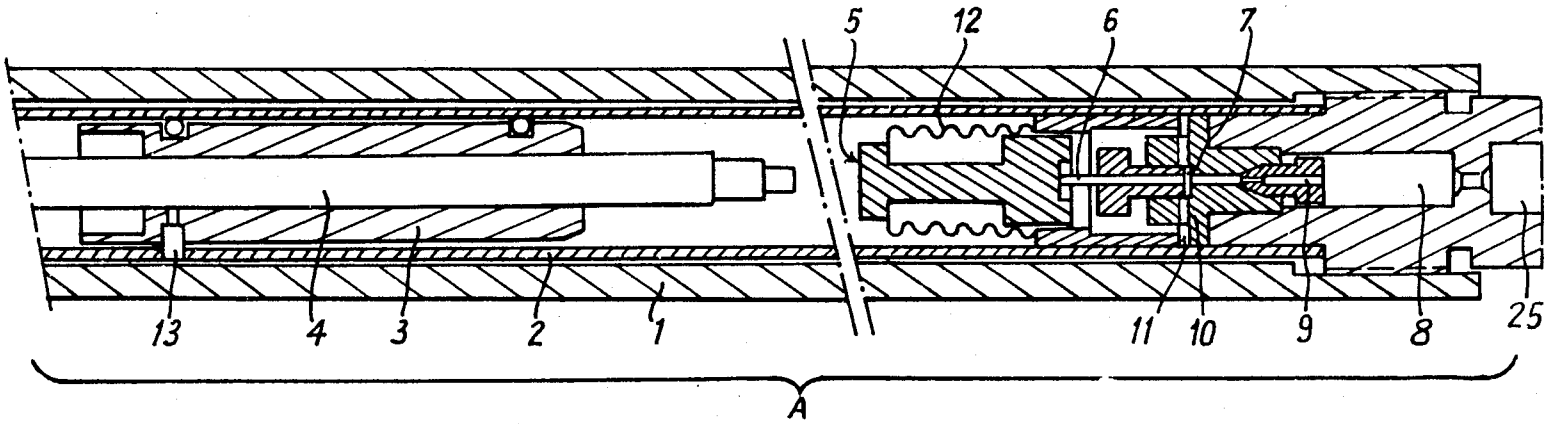
FIG. 1 shows the end part of the clock mechanism in cross-section.
Figure 3:
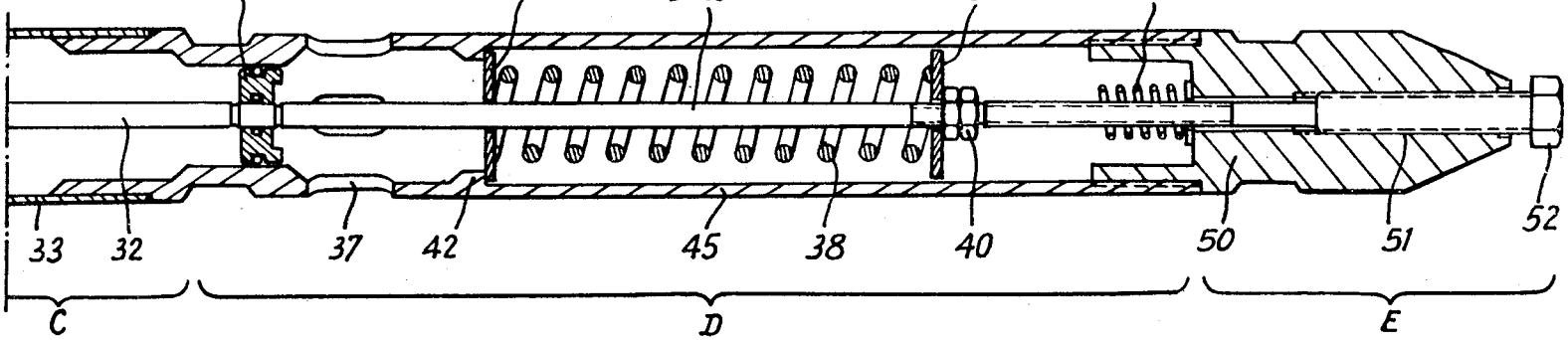
FIG. 3 shows another part of the syringe body, the opening mechanism and the end and guiding union.
Figure 2:
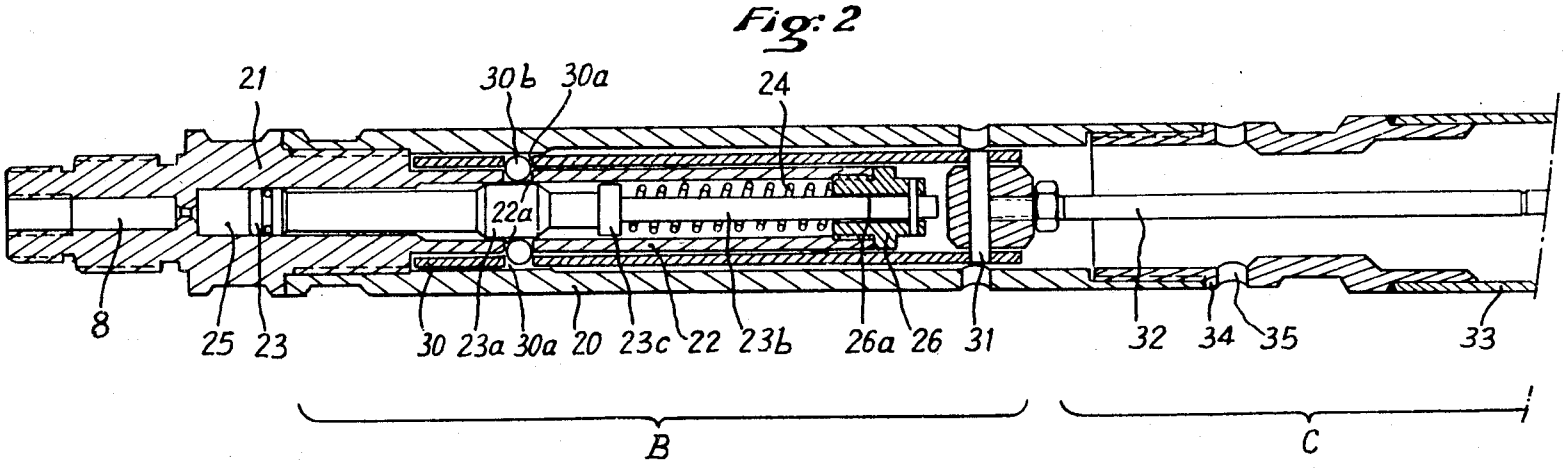
FIG. 2 shows the hydraulic bolt end and a part of the syringe body in cross-section.

The device shown in the drawings is composed of the following parts: the clock mechanism A, the hydraulic bolt B, the main syringe body C, the opening mechanism D and the end and guiding union E.

The clock mechanism A is a mechanism universally known in the petroleum field by the name Amerada and it is, for example, described in French Pat. No. 2087013. It consists of a clock, not shown, placed in a casing 1 which imparts a rotary movement to a screwthreaded rod 4 which turns in a nut 3, serving as a block, mounted in a liner 2 by means of a stud 13. On the side of the bottom end of the rod 4, the casing 1 encloses a hollow barrel housing a chamber for pressurised oil 8 discharging axially through a calibrated nozzle 9 into a hollow axial passage in a support 10 of a cap 7 which occludes the said passage. At the other end, close to the cap, there is the opening of an axial passage in which is located a striker 6 above which is placed a mass 5 serving as a support for the striker 6 and sheathed in a bellows 12.

Passages 11 for the flow of oil are provided in the support 10.

This mechanism functions in the following way.

The clock is regulated to trigger the operation within a predetermined period, the rod 4 rotates to lower the block 3 which, released after a given time has elapsed, falls onto the shoulder or head of the striker 5 which transmits the momentum to the striker 6 which pierces the cap 7. The pressurised oil contained in the chamber 8 flows through the calibrated nozzle 9 and the passages 11 to the interior of the bellows 12.

The hydraulic bolt B comprises a casing 20 screwed onto a bolt body 21 extending by a hollow cylindrical portion 22 which forms a fixed liner. The end of this part is rigid with an end nut 26. A circular notch **22*a* is provided to house balls 30*b***.

In its upper part, the bolt body 21 comprises a cylinder 25 filled with pressurised oil, communicating with the chamber 8 of the clock mechanism A and in which slides a piston 23 extended by a rod **23*b* which incorporates a portion of increased cross-section 23*a*. The diameter of this enlarged portion corresponds to the diameter of the widened-out portion present in the hollow cylindrical part 22. During the course of descent, the pressure of the well is exerted on the piston 23, pressurising the oil. The end of the rod 23***b* of the piston is capable of sliding in an axial bore 26*a* in the nut 26 under the effect of the action of a restoring spring 24 bearing at one end on the nut 26 while at the other it exerts its thrust on a shoulder 23*c* on the rod 23*b*. Thus, freedom of movement of the piston 23 is ensured to compensate for the effects of expansion of the oil in the chamber 25.

Between the casing 20 and the hollow cylindrical part of the bolt 22 there is an annular space into which is inserted a movable liner 30 carrying a circular notch 30*a* which forms another part of the housing for the balls 30*b* when the notches 22*a* are opposite and at the same level as the notches 30*a*.

The bottom end of the liner 30 is rigid, by means of a connecting pin 31, with a central rod 32 serving as a valve-carrying spindle and traversing the main body of the syringe.

The main body of the syringe C is fixed to the body of the hydraulic bolt B by means of a union 34 provided with an aperture 35 for equalising pressures. The main body is constituted by a hollow cylinder 33 of which the length and capacity may vary according to the volume of substances to be injected, for example from 2 to 4 litres. Connected to the end of the liner 33 by screwing is the body 45 of the opening mechanism D provided with orifices 37 for discharge of the substances. Fixed to the other end of the body 45 by screwing is an end and guide union E comprising an ogival casing 50 facilitating sliding during the descent and provided with a central bore 51 for passage of the central rod 32. To retain the central rod during assembly and installation, a nut 52 is provided which is subsequently withdrawn.

The lower part of the rod 32 carries, close to the orifices 37, a valve 36 which serves to occlude the filling cross-section of the syringe body. The rod 32 is urged downwardly by a restoring spring 38 which is threaded onto the part 32*a* of the rod, bearing on a washer 41 which is retained on a shoulder 42 of the body 45 and exerting its thrust downwardly onto a washer 39 fixed to the rod 31 by means of a double nut 40, by means of which the tension of the spring 38 can be regulated. The end union 50 serves as a seating for a spring 53 which acts as a shock absorber when lowering of the rod is triggered too violently.

The syringe functions in the following way.

The syringe body is filled and connected to the installation and the central rod is fitted so that the valve 36 is located above the orifices 37.

The chamber 8 and the cylinder 25 are filled with oil and the clock mechanism is adjusted to the desired time value. The liner 22 is in its low position while the liner 30 is in its raised position, the balls 30*b* occupying a housing formed by notches 22*a* and 30*a* located opposite one another and blocked by the presence of the enlarged diameter portion 23a of the piston 23 at the height of this housing. When the striker 6 punctures the cap 7, the oil flows from the cylinder 25 and under the effect of the pressure in the well the piston 23 rises, releasing the housing of the balls 30*b* which move towards the inside, allowing the liner 30 to fall. The rod 32 rigid with the liner 30 is biased by the spring 38 and moves downwardly, exposing the apertures 37, through the action of the valve 36, so that the product to be deposited in the well flows out through these apertures.

The device according to the invention makes it possible to vary the volume of the filling of product which is to be deposited in the well. Indeed, in case of need, it is possible to use either a main syringe body of a volume adapted to requirements or to connect to the main body, which may have a capacity of, for instance, 3 liters, one or a plurality of extensions representing secondary syringe bodies, for example of lessor capacities such as around 2 liters.

I claim:

1. Apparatus for injecting fluid material into a well, comprising an elongated assembly which contains, seriatim, an elongated timer mechanism (A), an elongated hydraulic latch mechanism (B) having one end connected to one end of said timer mechanism; an elongated hollow fluid container (C) for containing the fluid to be injected and having one end thereof connected to the opposite end of said latch mechanism, and an elongated end and guide mechanism (D) connecting to the opposite end of said elongated hollow fluid container; said timer mechanism including a rupturable cap (7) and a pressurized chamber (8) which is sealed by said cap and means (3, 4, 5, 6) for rupturing said cap after a predetermined time delay to enable controlled release of pressure from said pressurized chamber; said elongated hydraulic latch mechanism comprising an elongated piston (23) having one surface thereof defining one end of said pressurized chamber whereby said piston moves longitudinally toward the opposite end of said pressurized chamber when said cap is ruptured, and further including a longitudinally movable operating rod (30) and a latch means (30*a*, 30*b*) coupled between said longitudinally movable operating rod and said elongated piston, whereby said latch means is defeated in response to a predetermined axial movement of said elongated piston; said elongated hollow fluid container containing valve means (36, 37) in said hollow fluid container, said valve means being operable between opened and closed positions whereby said fluid material in said hollow fluid container is injected into said well when said valve is open and biasing means (38) coupled to said valve means for biasing said valve means to its said closed position, and connector means (31, 32) connecting said longitudinally movable operating rod to said valve, whereby said biasing means opens said valve when said latch means is defeated.

2. The apparatus of claim 1 wherein said elongated piston has an enlarged radius segment and wherein said latch means is coupled between said longitudinally movable operating rod and said enlarged radius segment of said elongated piston when said latch means is engaged.

3. Apparatus according to claim 2 wherein said latch means comprises a body transversely movable in response to the radius of said elongated piston.

4. Apparatus according to claim 3 wherein said biasing means comprises a spring.

* * * * *